United States Patent [19]

McGowan

[11] Patent Number: 4,763,472

[45] Date of Patent: Aug. 16, 1988

[54] POWER TRANSFER UNIT

[75] Inventor: Peter T. McGowan, Tempe, Ariz.

[73] Assignee: Allied Signal Inc., Morris Township, Morris County, N.J.

[21] Appl. No.: 18,882

[22] Filed: Feb. 25, 1987

[51] Int. Cl.[4] ..... F04B 1/16; F04B 17/00

[52] U.S. Cl. ..... 60/403; 60/420; 417/271

[58] Field of Search ..... 60/420, 403, 325; 417/271, 237

[56] References Cited

U.S. PATENT DOCUMENTS

| | | | |
|---|---|---|---|
| 3,890,064 | 6/1975 | Boehringer et al. | 417/237 |
| 4,168,652 | 9/1979 | Bick | 417/271 X |
| 4,286,927 | 9/1981 | Boehringer | 417/271 |
| 4,297,086 | 10/1981 | McGowan . | |

*Primary Examiner*—Edward K. Look

*Attorney, Agent, or Firm*—Terry L. Miller; James W. McFarland

[57] ABSTRACT

A power transfer unit coupling two otherwise separate hydraulic systems for bidirectional transfer of hydraulic power therebetween without transfer of fluid between the two systems. Control of the power transfer unit is effected using only hydraulic pressures, and static operation of the unit is maintained without power transfer until a determined pressure differential between the coupled systems is achieved to reduce wear and increase service life of the unit. Once dynamic power transferring operation of the unit is initiated, a pressure differential lower than the determined level is maintained between the two systems.

25 Claims, 3 Drawing Sheets

124
32
68

148
126
128
154
152
136
174
132
178
174
130
180
182
134
140
142
138
144
146
160
156
164
162
206
104
212
108
112
100
120
96
98
94
210
102
122
114
110
106
214
166
36
34
76
66
62
52
56
54
58
60
64
66
88
82
84
80
86
90
92
70
72
74
78
44
48
76
46
42
146
160

POWER TRANSFER UNIT

BACKGROUND OF THE INVENTION

The field of the present invention is reversible hydraulic motor-pump units. More particularly, the present invention relates to power transfer units wherein two reversible hydraulic motor-pump units are coupled for torque transfer therebetween. Each one of the motor-pump units is associated with a separate hydraulic system having its own main high-pressure pump and fluid reservoir. By means of the power transfer unit, hydraulic power may be borrowed from one system for conversion into mechanical power by one of the motor-pump units, and then converted by the other motor-pump unit into hydraulic power which is supplied to the other of the two hydraulic systems.

It is conventional in modern aircraft to provide a plurality of separate hydraulic systems by which the various control functions of the aircraft may be performed. For example, the hydraulic systems of the aircraft may be used to move and selectively position control surfaces such as the slats or flaps of the wing, and to raise and lower the aircraft landing gear. In order to improve the level of flight safety, the hydraulic systems may be in redundant relationship with respect to performing some control functions. In order to provide such plural and partially redundant hydraulic systems while also minimizing the weight required for such systems, it is common to provide hydraulic power transfer units between the plural systems. These conventional hydraulic power transfer units provide for borrowing of hydraulic power from one system in order to meet a need in a coupled system which is beyond the supply capability of the primary high-pressure pump of that system which is borrowing power. Additionally, it is necessary that the hydraulic power transfer units prevent transfer of fluid between the coupled systems such that a failure of one system does not incapacitate a coupled system.

However, it is recognized in the field that conventional hydraulic power transfer units have several shortcomings. Among the shortcomings is a tendency for conventional units to operate too frequently. That is, a relatively low level of hydraulic pressure differential between two coupled hydraulic systems will result in conventional power transfer units operating in order to minimize the pressure differential between the coupled systems. Such overly frequent operation results in increased wear and shortened service life for conventional power transfer units. Another recognized shortcoming of conventional power transfer units is the possibility of failure of one portion of the power transfer unit resulting in failure of both of the coupled systems due to fluid leakage between the two systems.

Those conventional power transfer units which provide for bi-directional transfer of power between coupled hydraulic systems have in many cases also employed relatively complex electro-hydraulic control systems. Such complexity is undesirable because it provides additional failure modes for the power transfer unit. The necessity of providing electrical power to such units is also a disadvantage.

SUMMARY OF THE INVENTION

In view of the above, it is a primary object of the present invention to provide a hydraulic power transfer unit which will not operate until a predetermined pressure differential exists between the two hydraulic systems which are coupled by the power transfer unit. An additional object of the present invention is to provide a power transfer unit of the above character which once operating will maintain a pressure differential between the coupled hydraulic systems which is lower than the predetermined pressure differential necessary to begin operation of the power transfer unit.

Yet another object of the present invention is to provide a power transfer unit of the above-described character wherein leakage of fluid between the two hydraulic systems coupled by the power transfer unit is positively prevented.

Still another object of the present invention is to provide a power transfer unit using entirely hydraulic control derived from one of the two hydraulic systems coupled by the power transfer unit.

Accordingly, the present invention provides a power transfer unit having a first reversible fluid motor-pump unit of selectively variable displacement and a second reversible fluid motor-pump unit of fixed displacement. Each of the motor-pump units has respective high-pressure and low-pressure inlet/outlet ports as well as an input/output shaft by which mechanical power may be delivered to or derived from the motor-pump unit. The first and second motor-pump units are coupled via their respective input/output shafts for torque transfer therebetween with attendant reversal of rotational direction dependent upon which of the motor-pump units is operating as a pump and which is operating as a motor. Each of the first and second motor-pump units is associated with a separate respective fluid source means each having a respective primary high-pressure pump providing relatively higher pressure fluid to the high-pressure inlet/outlet port of a respective one of the motor-pump units and a comparatively lower pressure fluid to the low-pressure inlet/outlet port of the respective one of the motor-pump units. Fluid pressure responsive control means is provided which is responsive to the comparatively higher pressure of both of the two fluid source means such that onset of operation of the power transfer unit to transfer power in either direction between the two coupled hydraulic systems is delayed until a predetermined fluid pressure differential exists between the two hydraulic systems. The fluid pressure responsive control means is also operative once power transfer is initiated between the two coupled hydraulic systems to maintain a selected fluid pressure differential therebetween which is less than the predetermined fluid pressure differential necessary to begin operation of the power transfer unit.

Other objects and advantages of the present invention will be apparent to those skilled in the pertinent art from a reading of the following detailed description of a single preferred embodiment of the invention taken in conjunction with the drawing FIGURES comprising a part of the present disclosure.

BRIEF DESCRIPTION OF THE DRAWING FIGURES

FIG. 1 schematically depicts a power transfer unit according to the present invention coupling two otherwise separate hydraulic systems each having a charging pump and primary high-pressure pump drawing fluid from a respective reservoir for supply to a respective load;

FIG. 2 depicts schematically and partially in cross section a power transfer unit according to the present invention; and FIG. 3 depicts a portion of FIG. 2 enlarged to better illustrate detail thereof.

DETAILED DESCRIPTION OF THE PREFERRED EMBODIMENT

Figure 1:
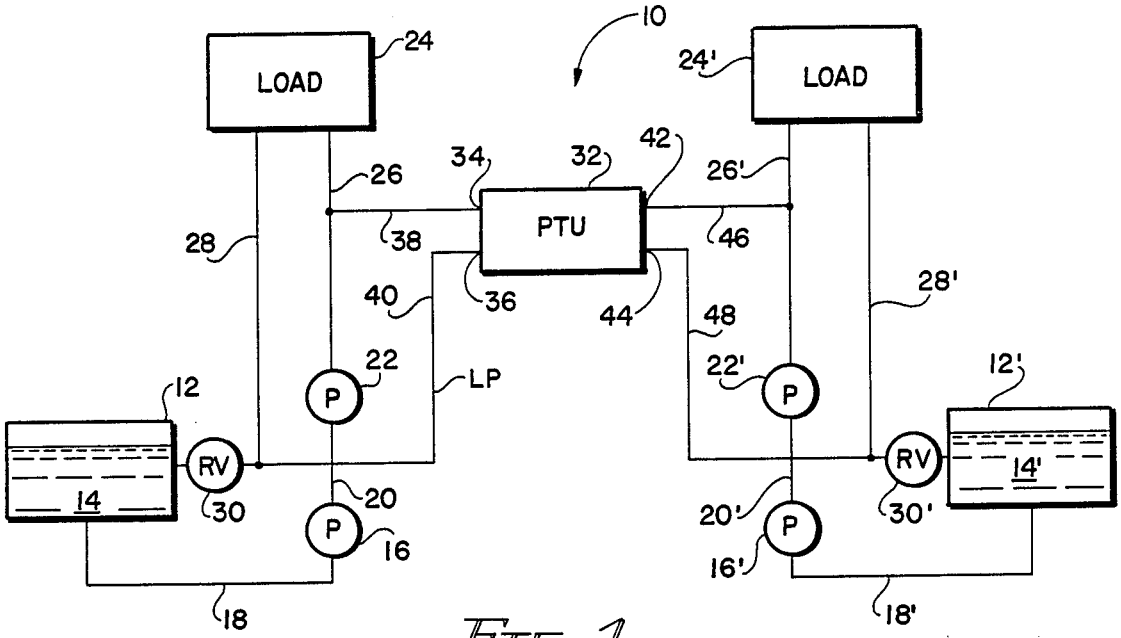

Generally referenced by the numeral 10 in the FIG. 1 are a pair of coupled hydraulic systems wherein many of the components thereof may be duplicated in each of the two hydraulic systems. Because of duplication of components in each of the two systems, reference numerals which are used to refer to a component of the system illustrated on the left-hand portion of FIG. 1 which is duplicated on the right-hand portion of FIG. 1 are also employed on the right-hand portion of the FIGURE with a prime added thereto.

Viewing now the left-hand portion of FIG. 1, it will be seen that a reservoir 12 is provided wherein a store of hydraulic fluid 14 is received. Fluid 14 flows from reservoir 12 to a charging pump 16 via a conduit 18. The charging pump 16 provides the fluid pressurized to an intermediate level via a conduit 20 to a primary or main high-pressure pump 22. The pump 22 provides high-pressure fluid to a load 24 via a conduit 26. The load 24 may comprise any of a variety of motors or actuators which are driven by high-pressure hydraulic fluid selectively under the control of manual or automatic devices. During operation of the system 10, the load 24 has a pressure fluid absorption or consumption characteristic which varies markedly dependent upon the number and size of actuators, motors, and other devices which are drawing fluid from the conduit 26 at any one particular time. Relatively lower pressure fluid is exhausted from the load 24 via a conduit 28 which couples with conduit 20 intermediate of the charging pump 16 and high-pressure pump 22. A relief valve 30 couples conduit 28 to the reservoir 12 such that the pressure in ccnduit 20 and 28 is limited to about 150% of the design discharge pressure of charging pump 16.

Interconnecting the two hydraulic systems described immediately above is a power transfer unit 32. The power transfer unit 32 includes a first high-pressure inlet/outlet port 34 and first low-pressure inlet/outlet port 36 which are respectively connected with the conduits 26 and 20 via conduits 38 and 40. Similarly, the power transfer unit 32 includes second high-pressure inlet/outlet port 42 and second low-pressure inlet/outlet port 44 which are respectively connected with the conduits 26' and 20' via conduits 46 and 48.

During operation of the system 10, all of the pumps 16, 16', 22 and 22' are driven such that high-pressure fluid is supplied at equal design pressure levels via the conduits 26, 26' to the respective loads 24, 24'. However, in the event that one of the loads 24 or 24' exceeds the pumping capability of its respective main high pressure pump 20 or 22', the fluid pressure level in the associated conduit 26, 26' will drop below the design pressure range for the hydraulic system. In such an event, the power transfer unit 32 is operative to "borrow" hydraulic power from the other of the two hydraulic systems. Alternatively, in the event that one of the hydraulic systems is disabled, for example, because of failure of its charge pump 16 or main high-pressure pump 22, the loads associated with that hydraulic system may still be operated, albeit at a lower level of speed or power consumption by transferring, via the power transfer unit 32, hydraulic power from the one of the two systems which still is fully functioning.

Figure 2:
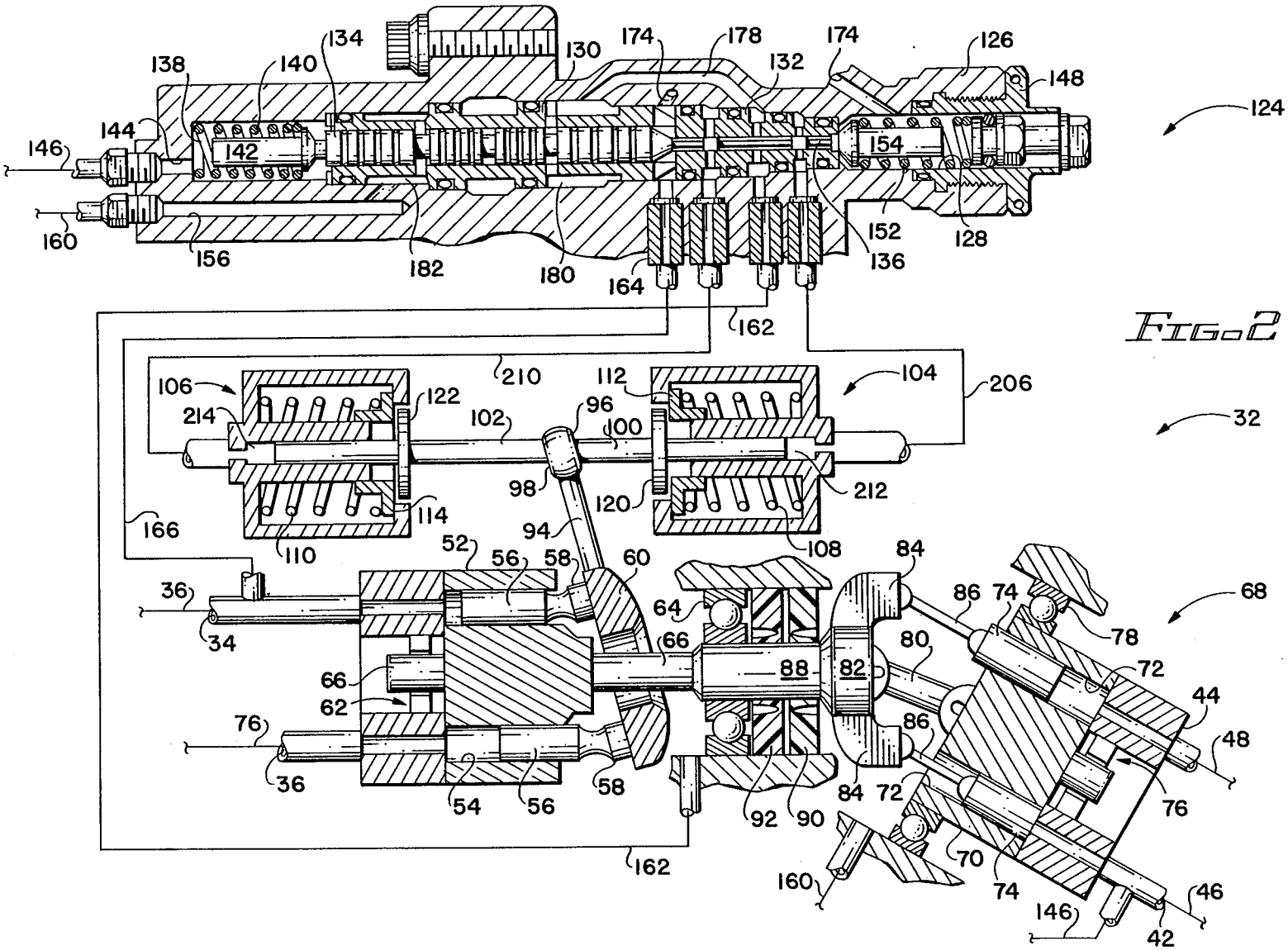

Considering now FIG. 2, it will be seen that the power transfer unit 32 includes a first variable-displacement motor-pump unit 50 which is of the axial piston swashplate type. The motor-pump unit 50 includes a rotational barrel 52 defining a plurality of axially extending bores 54 wherein are received a like plurality of axially reciprocal plunger units 56. The plungers 56 engage shoe members 58 which are in sliding engagement with a variableangle swashplate member 60. The barrel member 52 is journaled by bearings 62 and 64 which engage shaft portions 66 of the motor pump unit 50.

The power transfer unit 32 also includes a second fixed-displacement motor-pump unit 68 of bent axis type. The second motor-pump unit 68 includes a rotatable barrel portion 70 which defines a plurality of axially extending bores 72 reciprocally receiving a like plurality of axially reciprocal plunger members 74. The barrel member 70 is journaled by a pair of axially spaced apart bearing members 76 and 78 and is rotationally driven by a drive shaft member 80 having constant velocity universal joints on each end thereof. The universal joints drivingly engaging the barrel member 70 and a socket member 82, respectively, to couple these members for rotation in unison. Socket member 82 is drivingly connected with the shaft portion 66 of motor-pump unit 50, and defines a plurality of radially outwardly extending drive arms 84, matching in number the plurality of bores 72. Each one of the plunger members 74 is drivingly connected with a respective one of the drive arms 84 by a connecting rod 86 each having spherical termination ends thereon which are received in ball-and-socket relationship at a respective one of the drive arms 84, and with a respective one of the plunger members 74. In order to complete this preliminary description of the power transfer unit 32 it must be noted that a radially outer and axially extending surface 88 of the socket member 82 defines a sealing surface against which a pair of back-to-back fluid seals 90 and 92 are engaged. Further, the power transfer unit 68 includes a case which is only schematically depicted partially in FIG. 2, but which will be understood to receive and support the component parts of the unit. As a consequence, fluid transfer between the first fluid motor-pump 50 and the second fluid motor-pump 68 is positively prevented.

It will be understood viewing FIG. 2 that when high-pressure fluid is supplied to the conduits 38 and 46 as described hereinabove, each of the fluid motor-pump units 50 and 68 tends to operate as a motor and to drive the other of the fluid motor-pump units. However, because the fluid motor-pump units 50 and 68 are coupled to oppose one another and have substantiaI static friction, there will exist within a certain range of fluid pressures within the conduits 38 and 46 a static torque balance between the fluid motor-pump units. However, when the fluid pressure differential between the conduits 38 and 46 exceeds the above-mentioned range, one of the fluid motor-pump units 50 or 68 will begin to operate as a motor and to drive the other of the fluid rotor-pump units in its pumping mode of operation. Under such conditions, the driving motor-pump unit will receive pressurized fluid at the respective conduit 38 or 46 and discharge spent fluid via the respective conduit 40 or 48. The motor-pump unit which is being driven in a pumping mode will receive relatively lower-pressure fluid via the conduit 40 or 48 and will discharge this fluid pressurized via the respective conduit 46 or 38. It will be further recognized that the static torque balance between the fluid motor-pump units 50 and 68 is greatly influenced by the angular position of the swashplate member 60. Also, this angular position greatly influences the operating speed and torque versus pressure characteristic of the power transfer unit 32 in operation.

In order to control the angular position of the swashplate member 60, an elongate control arm 90 is attached thereto. At its outer end, the control arm 94 defines oppositely disposed arcuate surfaces 96 and 98. The arcuate surfaces 96 and 98 are received between the precisely spaced apart opposite ends of control plungers 100 and 102. Each of the plungers 100 and 102 defines an operative part of respective control assemblies 104 and 106. Each of the control assemblies 104 and 106 is similar in construction, although they may differ in effective fluid pressure-responsive area. Viewing the control assemblies 104 and 106, it will be seen that each includes a respective coil compression spring 108, 110 extending between a rear wall of the control assembly and respective annular moveable spring seat members 112, 114. The spring seat members 112, 114 each respectively engage in annular radially inwardly extending portion of the 116, 118 of the respective control assembly as well as an annular radially outwardly extending collar part 120, 122 of the respective plunger 100, 102. Consequently, a rest position is defined for the control arm 94 wherein each of the spring seats 112, 114 is in engagement with the respective annular portion 116, 118 as well as its respective collar part 120, 122. In the rest position of the lever 94, the swashplate member 60 defines a selected angle with respect to a perpendicular from the shaft 60. Consequently, the first motor pump unit 50 defines at the rest position of lever 94 a selected effective fluid displacement per rotation of the shaft 66, and also has a selected characteristic of static and dynamic torques verses fluid pressure and operating speed, respectively.

Figure 3:
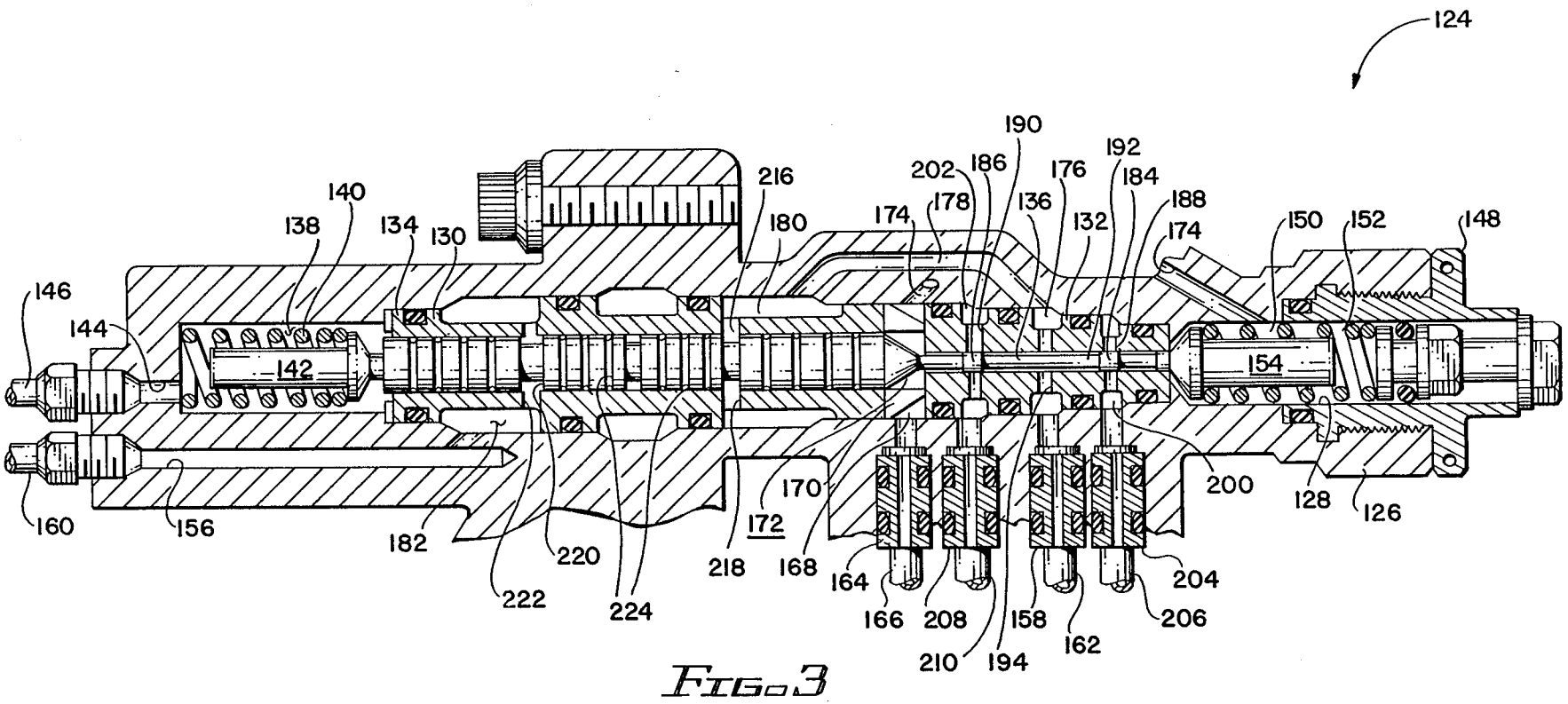

Also included by power transfer unit 32 is a fluid pressure responsive control valve apparatus 124, viewing now FIGS. 2 and 3. The control valve apparatus 124 includes a housing 126 defining a stepped bore 128 therein. Received within the step bore 128 are a pair of sleeve members 130, 132, respectively receiving a plunger member 134, and a spool valve member 136. At the left end of the control valve assembly 124 the sleeve 130 and plunger 134 cooperate with the housing 126 to define a chamber 138 receiving a coil compression spring 140 and a spring seat member 142. At its right end the member 142 bears against the plunger member 134. A port 144 opens to chamber 138 and communicates therefrom to the high pressure conduit 46 of the second motor-pump unit 68 via conduit 146. Similarly, at the right end of the control valve apparatus 124 the housing 126 cooperates with a cap member 148 to define a chamber 150 wherein is received a respective coil compression spring 152 extending between the cap member 148 and a spring seat member 154. The spring seat 154 bears upon the right end of the spool valve 136 to bias the latter into engagement with the plunger member 134. The housing 126 also defines ports 156 and 158 which respectively communicate separately with the interior or case cavities of the respective first and second motor-pump units 50 and 68 via conduits 160 and 162. A port 164 defined by the housing 126 communicates with the high pressure conduit 38 of the first fluid motor-pump unit 50 via a respective conduit 166.

Within the housing 126 the sleeves 130 and 132 cooperate to define an annular chamber 168 communicating with the port 164 and conduit 166. The sleeve 130 defines a radially extending notch 170 at the end thereof abutting sleeve member 132. The notch 170 communicates pressurized fluid from conduit 166 to a chamber 172 defined intermediate of the ends of the plunger member 134 and valve member 136. The housing 126 also defines a passage 174 communicating from the chamber 168 to the chamber 150. Consequently, the spool valve member 136 is exposed at both of its ends to pressure fluid communicated via conduit 166 from the high-pressure port 38 of motor-pump unit 50. Similarly, the sleeve member 132 cooperates with housing 126 to define an annular chamber 176 communicating with port 158 and conduit 162. The housing 128 also defines a passage 178 communicating chamber 176 with an annular chamber 180 circumscribing the sleeve member 130. The chamber 180 is matched by like annular chamber 182 communicating with the passage 156 and conduit 160.

Viewing now the sleeve member 132 and spool valve member 136 in greater detail, it will be seen that the spool valve member 136 is slidably and sealingly received within the sleeve member 132. The spool valve meter 136 defines a pair of axially spaced apart lands 184 and 186 which in a centered position thereof align with axially and radially extending slot-like passages 188 and 190 defined by the sleeve member 136. An axially extending groove portion of the spool valve member 192 extends between the lands 184 and 186 and define as a radial clearance with sleeve member 132. A radially extending passage 194 communicates through the sleeve member radially outwardly of the groove portion 192 to the annular chamber 176. The slots 188 and 190 are of narrow circumferential extent, and the axial ends thereof precisely align in sealing relationship with the axial ends of the lands 184 and 186. Radially outwardly of the slots 188 and 190, the housing 126 cooperates with sleeve member 136 to define respective annular chambers 200 and 202. The chamber 200 is communicated via a port 204 and conduit 206 with the control assembly 104. Similarly, chamber 202 is communicated by a port 208 and conduit 210 with the control assembly 106. Recalling the structure of the control assemblies 104 and 106, it will be seen that the conduit 206 opens into a chamber 212 cooperatively defined by the plunger 100 and the remainder of control assembly 104. Similarly, the conduit 210 opens into a chamber 214 cooperatively defined by the plunger 102 and the remainder of control assembly 106.

In order to complete this description of the control valve apparatus 124, it must be noted that the sleeve member 130 cooperates with the plunger member 134 to define an annular chamber 216 which communicates with the chamber 180 via a radially extending passage 218. Similarly, the plunger member 134 cooperates with sleeve member 130 to define an annular chamber 220 communicating with the chamber 182 via a radially extending passage 222. Intermediate of the ends of the plunger member 134 and spaced along the length thereof, the plunger member 134 defines a plurality of radially extending and circumferentially continuous grooves 224 which cooperate with the sleeve member 130 to define labyrinth seals.

Having observed the structure of the hydraulic system 10 and of the power transfer unit 32 thereof, attention may now be given to its operation. With all of the pumps 16, 16', 22 and 22' operating, the conduits 26 and 26' are charged with high-pressure fluid at substantially equal pressures according to the design of the hydraulic system 10. As the pressure fluid absorptions of the loads 24 and 24' vary as various load items thereof are valved in and out of operation, the fluid flow rates and pressures within the conduits 26 and 26' varies. Spent fluid from each of the loads 24 and 24' is returned via the respective conduits 28 and 28' to the conduits 20, 20' intermediate of the charging pumps 16, 16' and the main high-pressure pumps 22, 22'. The relief valves 30 and 30' operate to limit the pressure within conduits 20 and 20' to about 150% of the design output pressure of the charging pumps 16 and 16'. Accordingly, the conduits 40 and 48 communicating with the power transfer unit 32 are also maintained at a pressure between the design discharge pressure of the charging pumps 16, 16' and the relief pressure value of the respective relief valves 30 and 30'.

While the conduits 26 and 26' are charged to pressure levels which are substantially at the design pressure level for the hydraulic system 10, the motor-pump units 50 and 68 of power transfer unit 32 will not be operating despite fluid pressure variation within conduits 26 and 26' which are within a limited and predetermined range. Such is the case because the motor-pump units 50 and 68 are connected via the shaft portions 66 and 80 in opposing torque relationship. Even though the torque produced by one of the motor-pump units 50 and 68 may exceed that opposing torque produced by the other of the motor-pump units, the torque differential between the two units is not sufficient to overcome the static friction, or breakaway torque, required to start the two units into rotation. However, even while the two motor-pump units 50 and 68 are static, the control valve apparatus 124 is effective to actuate the control assemblies 104 and 106 in preparation for beginning of operation of the motor-pump units 50 and 68.

By way of example only, the load 24 may be exceeding the pumping capacity of high-pressure pump 22 such that the pressure in conduit 26 is lower than that in conduit 26', but the pressure differential therebetween is not sufficient to begin operation of the motor-pump units 50 and 68. The relatively lower fluid pressure in conduit 26 is communicated via conduit 38 to port 34 and therefrom via conduit 166 into chambers 170, and thence via passage 174 to chamber 150. On the other hand, the comparatively higher fluid pressure from conduit 26' is communicated via conduit 46 to port 42 and thence via conduit 146 to chamber 183 at the left end of control valve apparatus 124. Accordingly, the pressure differential between chamber 138 and chamber 172 is effective to shift the plunger member 134 and spool valve member 136 slightly rightwardly in opposition to spring 152 viewing FIG. 2. Rightward movement of the spool valve member 136 shifts the land 186 rightwardly with respect to radially extending slot 190 to communicate chamber 172 with passage 190, and to communicate high-pressure fluid therefrom to conduit 210 via port 208. The high-pressure fluid communicated via conduit 210 to control assembly 106 is effective in chamber 214 to urge plunger member 102 rightwardly. Simultaneously, land 184 of spool valve member 136 is shifted slightly rightwardly with respect to passage 188 to communicate chamber 212 of control assembly 104 with the case of motor-pump unit 50 via the flow path defined by features 206, 204, 200, 188, 194, 176, 158, and 162. Therefore, fluid within chamber 212 of control assembly 104 is drained to the relatively low pressure established by charging pump 16 and relief valve 30. When the force effective on plunger 102 is sufficient to overcome the preload of spring 108, the lever 94 is moved rightwardly an amount dependent upon the spring rate of spring 108.

Viewing the motor-pump unit 50 in greater detail, in will be seen that rightward movement of lever 94 in response to the above-described sequence of events results in a movement of the swashplate member 60 from its rest position toward a position of decreased displacement for the motor-pump unit 50. Consequently, the resisting torque generated by motor-pump unit 50 is decreased while the driving torque generated by the motor-pump unit 68 retains its previous level. Consequently, the power transfer unit 32 is prepared for the beginning of operation with the motor-pump unit 68 operating as a motor driving motor-pump unit 50 in a pumping mode. Should the pressure differential between the conduits 26 and 26' reach the predetermined level whereat the breakaway torque of the motor-pump units 50 and 68 is exceeded by the torque differential therebetween, the latter units will begin operating with motorpump unit 68 driving motor-pump unit 50 to pump fluid from conduit 40 to conduit 38 to assist in maintaining the pressure level in conduit 26 approximately at the design pressure level. Once the motor-pump units 50, 68 of power transfer unit 32 begin operation, the difference between the static friction of the components of the power transfer unit and the dynamic frictions effective therein during operation results in the pressure differential maintained between the conduits 26 and 26' being less then that pressure differential which is necessary to begin operation of the power transfer unit. Accordingly, during operation of the power transfer unit, the control valve apparatus 24 modulates the position of control lever 94, and displacement of variable displacement motor-pump unit 50 in the range extending between the decreased displacement position thereof, and that displacement which is defined at the rest position of the swashplate member 60 and control lever 94.

On the other hand, in the event that the load 24' exceeds the pumping capacity of primary high-pressure pump 22' such that the pressure in conduit 26' is lower than that in conduit 26, a higher effective pressure will prevail in chamber 172 of the control valve apparatus 124 than that prevailing in the chamber 138. Consequently, the plunger member 134 will be shifted slightly leftwardly in opposition to compression spring 140 while the compression spring 152 acting through the spring seat member 154 urges the spool valve member 136 to follow plunger member 134. Such leftward movement of the spool valve member 136 results in communication between chamber 150 and port 204 and conduit 206 extending therefrom to control assembly 104. Also, such leftward shifting of the spool valve member 136 results in communication of conduit 210 from control apparatus control assembly 106 communicating via port 208 and passage 190 with the axially extending clearance between the groove portion 192 of spool valve 136 and sleeve 132 to drain fluid via passage 194 to conduit 162 communicating with the case of motor-pump unit 50. As a result, the control lever 94 is shifted leftwardly in opposition to compression spring 110 of the control assembly 106 according to the preload and spring rate thereof. Such shifting of control lever 94 moves the swashplate member 60 angularly to a position increasing the effective displacement and static torque of motor-pump unit 50 in preparation for operation thereof as a motor.

The increase in effective displacement of motor-pump unit 50 as described above results in this motor-pump unit generating a greater effective driving torque. On the other hand, the resisting torque generated by motor-pump unit 68 is decreased by the relatively lower fluid pressure effective in conduit 26' and communicating thereto via conduit 46. When the pressure differential between conduit 26 and 26' reaches the determined level necessary to overcome the break away torque requirement set by static frictions within the power transfer unit 32, operation thereof begins with motor-pump unit 50 operating as a motor driving motor-pump unit 68 in a pumping mode of operation. Consequently, the motor-pump unit 68 receives fluid via conduit 48 and delivers this fluid pressurized via conduit 46 to the conduit 26' to assist in meeting the demands of the load 24'. During such operation of the power transfer unit, the control valve assembly 124 acts to modulate the position of control lever 94 and of swashplate member 60 in the range extending from the maximum displacement position therefore to the rest position previously described.

In view of the above, it will be seen that when the power transfer unit is in operation with either one of the motor-pump units 50 and 68 driving the other, the control lever 94 and swashplate member 60 is modulated between the rest position thereof and either the minimum displacement position or maximum displacement position therefor according to the direction of operation of the power transfer unit. That is, if the power transfer unit is operating to transfer power from the left-hand side of the system illustrated in FIG. 1 to the right-hand side thereof, the swashplate member 60 is positioned in a range extending from the maximum displacement position thereof to the rest position therefore. On the other hand, if the power transfer unit 32 is operating to transfer power from the right-hand side of the hydaulic system illustrated in FIG. 1 to the left-hand side thereof, then the swashplate member 60 of motor-pump unit 50 is modulated in a range extending from the minimum effective displacement position therefore to the rest position. In view of this, it will be seen that when the load demand of either load 24 or 24' decreases such that the associated primary high-pressure pump 22 or 22' is able to meet the design pressure requirement for the hydraulic system 10, the control lever 94 and swashplate member 60 will be modulated to the rest position therefore. Consequently, operation of the power transfer unit 32 will continue until such time as the torque differential between the two motor pump units falls below the total of dynamic frictional torque effective within the power transfer unit 32 and the resisting torque of that unit which is being operated in the pumping mode. When this stall condition is reached, operation of the motor-pump units 50 and 68 of the power transfer unit 32 will cease. However, the control valve apparatus 124 and control assemblies 104 and 106 will be continuously operative to move the control lever 94 and swashplate member 60 away from the rest position thereof in anticipation of once again beginning operation of the motor-pump units of power transfer unit 32 as pressure levels in the conduits 26 and 26' vary dynamically in response to variations of pressure fluid utilization effective within loads 24 and 24'.

Having described my invention in sufficient detail to allow one skilled in the art to make and use same, I desire to protect my invention under applicable law according to the following claims. Several modifications will suggest themselves to those skilled in the art. For example, the singular preferred embodiment herein depicted and described is predicated upon coupling hydraulic systems of equal design operating pressures. However, it is considered easily within the skill of the art to couple systems of unequal design pressures by means of the present invention altered in the relative size and pressure responsive areas of component parts thereof as necessary. Such modification, and others, are intended to be encompassed by the appended claims. While my invention has been depicted and described by reference to a singular preferred embodiment thereof, such reference is not intended to imply a limitation upon the invention, and no such limitation is to be inferred. I desire to limit my invention only according to the scope and spirit of the following claims, which also provide additional definition of the invention.

I claim:

1. Power transfer apparatus comprising:

a first reversible fluid motor-pump unit of selectively variable displacement having a respective high-pressure inlet/outlet port, a respective low-pressure inlet/outlet port, and a respective rotational input/output shaft for receiving and delivering mechanical power;

a second reversible fluid motor-pump unit of fixed displacement having a respective high-pressure inlet/outlet port, a respective low-pressure inlet/-outlet port, and a respective, rotational input/output shaft for receiving and delivering mechanical power;

said first input/output shaft and said second input-/output shaft coupling in opposing torque relationship for rotational power transfer between said first motor-pump unit and said second motor-pump unit with rotational direction of said coupled input/output shafts being dependent upon which unit is driven by the other;

first pressure fluid source means communicating with said first motor-pump unit for delivering and receiving comparatively higher pressure fluid at said first high-pressure inlet/outlet port while respectively receiving and supplying lower pressure fluid at said first low-pressure inlet/outlet port;

second pressure fluid source means communicating with said second motor-pump unit for delivering and receiving relatively higher pressure fluid at said second high-pressure inlet/outlet port while receiving and supplying lower pressure fluid at said second low-pressure inlet/outlet port;

means sealingly separating said first and said second fluid source means from one another to prevent pressure fluid communication therebetween;

fluid pressure responsive control means communicating with both said first high-pressure inlet/outlet port and with said second high-pressure inlet/outlet port and responding to fluid pressure differentials therebetween for selectively varying the effective displacement per rotation of said first input-/output shaft of said first motor-pump unit;

whereby, a selected fluid pressure relationship is maintained between said first pressure fluid source and said second pressure fluid source by operating one of said first and said second motor-pump units as a pump and the other as a motor to transfer fluid power between said pressure fluid sources without exchange of pressure fluid therebetween.

2. The invention of claim 1 wherein said first motor-pump unit includes a member movable to selectively vary said effective displacement, said control means including resilient first means yieldably biasing said movable member to a selected first position of effective displacement, and pressure responsive means for moving said movable member to a second position of decreased effective displacement in opposition to said first yieldable means in response to a fluid pressure differential of said second pressure fluid source over said first pressure fluid source.

3. The invention of claim 2 wherein said control means further includes second resilient means yieldably biasing said movable member to said selected first position of effective displacement, and another pressure responsive means for moving said movable member to a third position of increased effective displacement in opposition to said second yieldable means in response to a fluid pressure differential of said first pressure fluid source over said first pressure fluid source.

4. The invention of claim 3 wherein said control means further includes stop means respectively opposing each of said first resilient means and said second resilient means at said selected first position of said movable member.

5. The invention of claim 4 wherein said control means pressure responsive means includes a housing defining a bore therein, a plunger member sealingly and movably received in said bore to define a variable-volume chamber, said plunger member defining a portion thereof engageable with said movable member to move the latter to said second position of decreased effective displacement and a second portion engageable with said stop means at said first selected position for said movable member.

6. The invention of claim 5 wherein said control means another pressure responsive means includes another housing defining a respective bore therewithin, another plunger member sealingly and movably received in said respective bore to define another variable-volume chamber and for movement in opposition to said plunger member, said another plunger member defining another portion engageable with said movable member to urge the latter to said third position of increased effective displacement and another second portion engageable with said stop means.

7. The invention of claim 6 wherein said control means further includes valve means communicating a selected one of said variable-volume chamber and said another variable-volume chamber with said comparatively higher pressure fluid of said first pressure fluid source while simultaneously communicating the other of said variable-volume chamber and said another variable-volume chamber with said lower pressure fluid of said first pressure fluid source in response to movement of said valve means in a selected one of two directions, pressure responsive means operatively associating with said valve means for moving the latter in each of said two directions, said pressure responsive means defining a first pressure responsive face and an oppositely disposed second pressure responsive face sealingly separated from one another, means communicating said first pressure responsive face with said comparatively higher pressure fluid of said first pressure fluid source to effect movement of said pressure responsive member and said valve means in a first of said two directions to communicate said another variable volume chamber with said comparatively higher pressure fluid, means communicating said second pressure responsive face with said relatively higher pressure fluid of said second pressure fluid source to effect movement of said pressure responsive member and said valve means in the second of said two directions to communicate said variable volume chamber with said comparatively higher pressure fluid, and resilient means yieldably biasing said pressure responsive member and said valve means to a centered position wherein neither of said variable volume chamber and another variable volume chamber communicates with said comparatively higher pressure fluid.

8. The invention of claim 7 wherein said control means pressure responsive means further includes an elongate plunger member defining at its opposite ends respectively said first and said second pressure responsive faces, said control means defining a first annular drain chamber circumscribing and communicating with said plunger member intermediate the ends thereof and most closely adjacent said first pressure responsive face, a second annular drain chamber circumscribing and communicating with said plunger member intermediate the ends thereof and spaced from said first drain chamber while being disposed most closely to said second pressure responsive face, first flow path means communicating said first drain chamber with said lower pressure fluid of said first pressure fluid source, and second flow path means communicating said second drain chamber with said lower pressure fluid of said second pressure fluid source, and means sealingly separating said first pressure responsive face, said first drain chamber, said second drain chamber, and said second pressure responsive face each from all of the others.

9. The invention of claim 8 wherein said means separating said first and said second pressure responsive face, and said first and said second drain chamber each from all of the others includes said plunger member being slidably received in close sealing relationship within a bore defined by said control means, and said plunger member defining plural radially extending and circumferentially continuous grooves spaced along the length thereof to define plural labyrinth seals within said bore.

10. The method of bidirectionally transferring power between otherwise separate hydraulic systems comprising the steps of:

providing a first reversible fluid motor-pump unit of selectively variable displacement having a respective high-pressure inlet/outlet port, a respective low-pressure inlet/outlet port, and a respective rotational input/output shaft for receiving and delivering mechanical power;

providing a second reversible fluid motor-pump unit of fixed displacement having a respective high-pressure inlet/outlet port, a respective low-pressure inlet/outlet port, and a respective, rotational input/output shaft for receiving and delivering mechanical power;

coupling said first input/output shaft and said second input/output shaft in opposing torque relationship for rotational power transfer between said first motor-pump unit and said second motor-pump unit with rotational direction of said coupled input/output shafts being dependent upon which unit is driven by the other;

communicating said first motor-pump unit to a first of said hydraulic systems for delivering and receiving comparatively higher pressure fluid at a design pressure level at said high-pressure inlet/outlet port while respectively receiving and supplying lower pressure fluid at said low pressure inlet/outlet port;

communicating said second motor-pump unit to a second of said hydraulic systems for delivering and receiving relatively higher pressure fluid at a respective design pressure level at said second high-pressure inlet/outlet port while receiving and supplying lower pressure fluid at said second low-pressure inlet/outlet port;

providing means sealingly separating said first and said second motor-pump units from one another to prevent pressure fluid communication therebetween; and providing fluid pressure responsive control means communicating with both said first high-pressure inlet/outlet port and with said second high-pressure inlet/outlet port and responding to fluid pressure differentials therebetween for selectively varying the effective displacement per rotation of said first input/output shaft of said first motor-pump unit.

11. The method of claim 10 further including the steps of:

during non-operation of said coupled first motor-pump unit and said second motor-pump unit increasing the effective displacement of said first motor-pump unit in response to a pressure differential of said first hydraulic system over said second hydraulic system; and in response to a pressure differential of said second hydraulic system over said first hydraulic system decreasing the effective displacement of said first motor-pump unit.

12. The method of claim 10 further including the steps of respectively increasing the driving static torque and alternatively decreasing the resisting static torque of said first motor-pump unit in anticipation of said first motor-pump unit operating as a motor and alternatively in anticipation of its operating as a pump.

13. The method of claim 12 further including sensing which of said first hydraulic system and said second hydraulic system has a fluid pressure lower than the design fluid pressure therefor, and decreasing the resisting static torque of said first motor-pump unit if said first hydraulic system has the lowered pressure, or alternatively increasing the static driving torque of said first motor-pump if said second hydraulic system has the lower pressure level.

14. In a power transfer unit coupling two otherwise separate hydraulic systems for bidirectional transfer of hydraulic power therebetween without transfer of fluid therebetween, and having a first variable displacement motor-pump unit having a rest displacement coupled in torque transmitting relationship with a second fixed displacement motor-pump unit, each of the motor-pump units being sealingly separated and fluidly communicating with a respective one of the two hydraulic systems, said power transfer unit having a determined static breakaway torque necessary for starting operation of said coupled motor-pump units, which breakaway torque is provided by the difference between the respective driving and resisting torques if said coupled motor-pump units, the method of operating said power transfer unit comprising: with said coupled motor-pump units static, lowering with respect to said rest displacement the effective displacement and resisting torque of said first motor-pump unit in response to relatively lowered pressure of the hydraulic system coupled thereto and anticipation of operation of said first motor-pump unit as a pump driven by said second motor-pump unit, and increasing with respect to said rest displacement the effective displacement and driving torque of said first motor-pump unit in response to relatively lowered pressure of the hydraulic system coupled to said second motor-pump unit and anticipation of operation of said second motor-pump unit as a pump driven by said first motor-pump unit.

15. The method of claim 14 further including setting a determined pressure differential between said hydraulic systems necessary for static breakaway to begin operation of said coupled motor-pump units by variation of the effective displacement of said first motor-pump unit selectively below and above said rest displacement.

16. The method of claim 15 further including during operation of said coupled motor-pump units controlling the effective displacement of said first motor-pump unit during operation thereof as a pump in a range bounded by said rest displacement and a comparatively lowered displacement, and during operation of said first motor-pump as a motor controlling the displacement thereof in a range bounded by said rest displacement and a relatively increased displacement.

17. Power transfer apparatus comprising: a first reversible fluid motor-pump unit of selectively variable displacement having a respective high-pressure inlet/-outlet port, a respective low-pressure inlet/outlet port, and a respective rotational input/output shaft for receiving and delivering mechanical power; a second reversible fluid motor-pump unit of fixed always-positive displacement having a respective high-pressure inlet/outlet port, a respective low-pressure inlet/outlet port, and a respective, rotational input/output shaft for receiving and delivering mechanical power; said first input/output shaft and said second input/output shaft coupling in opposing torque relationship for rotational power transfer between said first motor-pump unit and said second motor-pump unit with rotational direction of said coupled input/output shafts being dependent upon which unit is driven by the other; first pressure fluid source means communicating with said first motor-pump unit for delivering and receiving comparatively higher pressure fluid at said high-pressure inlet/-outlet port while respectively receiving and supplying lower pressure fluid at said low pressure inlet/outlet port; second pressure fluid source means communicating with said second motor-pump unit for delivering and receiving relatively higher pressure fluid at said second high-pressure inlet/outlet port while receiving and supplying lower pressure fluid at said second low-pressure inlet/outlet port; means sealingly separating said first and said second fluid source means for one another to prevent pressure fluid communication therebetween; fluid pressure responsive control means communicating with both said first high-pressure inlet/outlet port and with said second high-pressure inlet/outlet port and responding to fluid pressure differentials therebetween for selectively varying the effective displacement per rotation of said first input/output shaft of said first motor-pump unit; said control means including a control member movable in opposite directions from a rest position to respectively decrease and increase the effective displacement of said first motor-pump unit with comparison to a respective rest displacement therefor, first and second oppositely-disposed pressure responsive plunger members bounding respective variable-volume cavities and engaging said movable member to move the latter in said respectively opposite directions from said rest position, first and second oppositely-disposed yieldable resilient members urging said movable member respectively from positions of decreased and increased effective displacement to but not beyond said rest position, a closed-center spool valve movable from a centered position to selectively communicate one of said variable-volume cavities with said comparatively higher pressure fluid of said first pressure fluid source while simultaneously communicating the other of said variable-volume cavities with said lower pressure fluid of said first pressure fluid source to selectively move said movable member in either one of said opposite directions from said rest position, a pressure responsive plunger member operatively coupling with said spool valve member to move the latter and defining oppositely disposed sealingly separated pressure-responsive faces, first and second flow path means communicating said first and said second pressure responsive faces respectively with a respective one of said first and said second pressure fluid source means, and opposed first and second yieldable resilient means biasing said plunger member to a centered position wherein said spool valve member is also in its respective centered position.

18. The apparatus of claim 17 wherein said first motor-pump unit is of axial piston swash plate type, said second motor-pump unit being of bent-axis axial piston type.

19. The invention of claim 18 wherein said movable member comprises a control lever affixed to a swash plate of said first motor-pump unit for angular movement thereof.

20. The method of operating a power transfer unit coupling two fluidly separate hydraulic systems each having a design fluid pressure level for hydraulic-mechanical-hydraulic power transfer bidirectionally therebetween and including a first variable displacement motor-pump unit communicating with a respective one of said two hydraulic systems, a second fixed displacement motor-pump unit communicating with the other of said two hydraulic systems, said motor-pump units being coupled in opposing torque relationship for mechanical power transfer therebetween while sealingly preventing fluid transfer between said two hydraulic systems, said method comprising the steps of continuously operating control apparatus selectively varying the effective fluid displacement of said first variable displacement motor-pump unit in anticipation of its operation as a pump and as a motor in response to respective fluid pressure differentials between said two hydraulic systems, maintaining said coupled motor-pump units static so long as the fluid pressure differential is less than a determined value, initiating operation of said coupled motor-pump units upon said fluid pressure differential between said two hydraulic systems achieving said determined level to transfer hydraulic power to the one of said two hydraulic systems whose pressure is most below its respective design pressure level, and during operation of said coupled motor pump units maintaining said pressure differential between said coupled hydraulic systems at a level less than said determined level by hydraulic power transfer via said power transfer unit.

21. The method of claim 20 wherein said motor-pump units are maintained inoperative so long as the pressure differential between said two hydraulic systems is less than said determined level by the steps of providing said coupled motor-pump units with a ratio of static friction to static torque versus fluid pressure resulting in a breakaway torque level required to begin operation of said coupled motor-pump units, and during inoperation of said motor-pump units setting a rest value of effective displacement for said first variable displacement motor-pump unit which ensures that said break away torque value cannot be achieved at differential pressures less than said determined value.

22. The method of claim 21 wherein said step of initiating operation of said coupled motor-pump units at said determined fluid pressure differential further includes the steps of in response to a fluid pressure differential of said first hydraulic system over said second hydraulic system shifting the effective displacement of said first motor-pump unit from said rest value to an increased value and increasing its ratio of static driving torque versus fluid pressure in anticipation of its operation as a motor driving said second motor-pump unit upon said fluid pressure differential achieving said determined value, and in response to a fluid pressure differential of said second hydraulic system over said first hydraulic system shifting the effective displacement of said first motor-pump unit from said rest value to a decreased value and decreasing its ratio of static resisting torque versus fluid pressure in anticipation of its operation as a pump driven by said second-motor upon said fluid pressure differential achieving said determined value.

23. The method of claim 20 wherein said pressure differential between said two hydraulic systems is maintained at a level less than said determined level by the steps of providing said coupled motor-units with a ratio of dynamic torque versus fluid pressure more favorable than said ratio of static torque versus fluid pressure such that once started operation of said coupled motor-pump units continues despite a lower level of fluid pressure differential between said two hydraulic systems, and during operation of said coupled motor-pump units at a pressure differential less than said determined pressure differential returning the effective displacement of said first motor-pump unit from said increased value or said decreased value to said rest value.

24. A power transfer unit comprising:

a first variable displacement fluid pump-motor unit having associated high and low pressure fluid ports and a first rotary shaft, said first unit operable to convert energy between pressurized fluid flow and mechanical rotation of said first shaft;

a second fixed displacement fluid pump-motor unit also having associated high and low pressure fluid ports and a second rotary shaft, said second unit operable to convert energy between pressurized fluid flow and mechanical rotation of said second shaft, said first and second shafts being mechanically interconnected for common rotation to transmit power between said first and second units without mixture of fluids therein; and control means for adjusting the displacement of said first unit, said control means responsive to the pressures of said high pressure ports of both said first and second units and operable to maintain the pressure differential therebetween below a preselected level whenever said first and second shafts are rotating.

25. A method of transferring power between first and second hydraulic systems each having a source of relatively high-pressure delivery fluid, without intermixture of fluids in the first and second systems, comprising the steps of:

utilizing the pressure delivery fluid of the first hydraulic system to urge a first, variable displacement, rotary pump-motor unit to rotate in a first direction;

utilizing the pressure delivery fluid of the second hydraulic system to urge a second, fixed displacement, rotary pump-motor unit to rotate in a second, opposite direction, the first and second pump-motor units being mechanically interconnected for common rotation such that the urgings of the pressure delivery fluids of the first and second systems oppose one another;

sensing the difference in pressure of the pressure delivery fluids of the first and second systems; and adjusting the displacement of the first pump-motor unit in response to said sensed difference in pressure to maintain said sensed difference in pressure below a predetermined level whenever said first and second units are rotating.

* * * * *

UNITED STATES PATENT AND TRADEMARK OFFICE

CERTIFICATE OF CORRECTION

PATENT NO. : 4,763,472

DATED : August 16, 1988

INVENTOR(S) : PETER T. MCGOWAN

It is certified that error appears in the above-identified patent and that said Letters Patent is hereby corrected as shown below:

Column 13,
Claim 10, line 46 (third line from end of claim), delete "rctation", insert -- rotation --.

Claim 14, line 14 (last line of Column 13), delete "if", insert -- of --.

Signed and Sealed this

Thirty-first Day of January, 1989

*Attest:*

DONALD J. QUIGG

*Attesting Officer*

*Commissioner of Patents and Trademarks*